US005547803A

United States Patent [19]

Wilson et al.

[11] Patent Number: 5,547,803

[45] **Date of Patent: *Aug. 20, 1996**

[54] QUATERNARY PHOSPHONIUM TRIHALOCUPRATE SALTS AS CHARGE-CONTROL AGENTS FOR TONERS AND DEVELOPERS

[75] Inventors: John C. Wilson, Rochester; Dinesh Tyagi, Fairport, both of N.Y.

[73] Assignee: Eastman Kodak Company, Rochester, N.Y.

[ * ] Notice: The term of this patent shall not extend beyond the expiration date of Pat. No. 5,459,006.

[21] Appl. No.: 350,603

[22] Filed: Dec. 7, 1994

[51] Int. Cl.[6] ..... G03G 9/097

[52] U.S. Cl. ..... 430/110; 430/106.6

[58] Field of Search ..... 430/110, 106.6

[56] References Cited

U.S. PATENT DOCUMENTS

| | | |
|---|---|---|
| 4,139,483 | 2/1979 | Williams et al. . |
| 4,338,390 | 7/1982 | Lu . |
| 4,394,430 | 7/1983 | Jadwin et al. . |
| 4,490,455 | 12/1984 | Hoffend et al. . |
| 4,496,643 | 1/1985 | Wilson et al. . |
| 4,537,848 | 8/1985 | Yourd, III et al. . |
| 4,684,596 | 8/1987 | Bonser et al. . |

*Primary Examiner*—Christopher D. Rodee
*Attorney, Agent, or Firm*—Willard G. Montgomery

[57] ABSTRACT

New electrostatographic toners and developers are provided containing charge-control agents comprising quaternary phosphonium trihalocuprate salts having the structure:

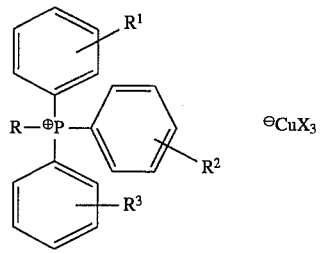

wherein

R is selected from an unsubstituted alkyl group having from 1 to 24 carbon atoms; a substituted alkyl group having from 1 to 24 carbon atoms substituted with one or more hydroxy-, carboxy-, alkoxy-, carboalkoxy-, acyloxy-, nitro-, cyano-, keto- or halo-groups; a cycloalkyl group having from 3 to 7 carbon atoms; an alkaryl group having from 1 to 20 carbon atoms in the alkyl group and 6 to 14 carbon atoms in the aryl group; an aralkyl group having from 1 to 4 carbon atoms in the alkyl group and 6 to 14 carbon atoms in the aryl group wherein the aryl group may be unsubstituted or substituted with one or more alkyl-, hydroxy, carboxy-, alkoxy-, carboalkoxy-, acyloxy-, amino-, nitro-, cyano-, keto- or halo-groups; phenyl or substituted phenyl;

$R^1$, $R^2$ and $R^3$, which can be the same or different, are independently selected from hydrogen; an alkyl group having from 1 to 24 carbon atoms; hydroxy-; carboxy-; alkoxy-; carboalkoxy-; acyloxy-; amino-; nitro-; cyano-; keto-; or halo-groups; and X, which can be the same or different, is independently selected from fluorine, chlorine, bromine or iodine.

4 Claims, No Drawings

QUATERNARY PHOSPHONIUM TRIHALOCUPRATE SALTS AS CHARGE-CONTROL AGENTS FOR TONERS AND DEVELOPERS

FIELD OF THE INVENTION

This invention relates to certain new electrostatographic toners and developers containing certain quaternary phosphonium trihalocuprate salts as charge-control agents. More particularly, the salts are thermally stable and can be well-dispersed in typical toner binder materials to form the inventive toners having good charging properties.

BACKGROUND OF THE INVENTION

In electrostatography, an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e. by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited on the latent image-bearing surface. In order to meet these requirements for proper development, the level of electrostatic charge on the toner particles should be maintained within an adequate range.

The toner particles in dry developers often contain material referred to as a charge agent or a charge-control agent, which helps to establish and maintain toner charge within an acceptable range. Many types of charge-control agents have been used and are described in the published patent literature.

One general type of known charge-control agent comprises a quaternary phosphonium salt. While many such salts are known, some do not perform an adequate charge-control function in any type of developer, some perform the function well in only certain kinds of developers, and some control charge well but produce adverse side effects.

A number of quaternary phosphonium salt charge-control agents are described, for example, in U.S. Pat. Nos. 4,496,643 and 4,537,848.

One of the important characteristics which is desirable for a quaternary phosphonium salt charge-control agent to possess is high thermal stability so that the salt will not totally or partially decompose during attempts to mix the salt with known toner binder materials in well-known processes of preparing toners by mixing addenda with molten toner binders. Such processes are often referred to as melt-blending or melt-compounding processes and are commonly carried out at temperatures ranging from about 120° C. to about 150° C. Thus, charge agents that are thermally unstable at temperatures at or below about 150° C. can exhibit this decomposition problem.

Another important property or characteristic for a quaternary phosphonium salt to possess is, as mentioned previously, the ability to establish toner charge within an acceptable range necessary for optimum toner development so that the quality of the image that is to be developed is ideal.

It would, therefore, be desirable to provide new, dry electrographic toners and developers containing quaternary phosphonium salts that could perform the charge-controlling function well, while avoiding or minimizing the drawbacks noted above. The present invention provides such toners and developers.

SUMMARY OF THE INVENTION

The present invention provides new, dry particulate electrostatographic toners and developers containing charge-control agents comprising quaternary phosphonium trihalocuprate salts having the structure:

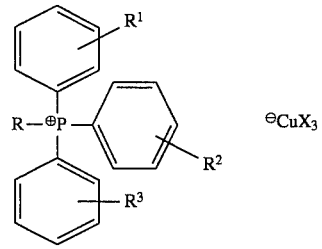

wherein

R is selected from an unsubstituted alkyl group having from 1 to 24 carbon atoms; a substituted alkyl group having from 1 to 24 carbon atoms substituted with one or more hydroxy-, carboxy-, alkoxy-, carboalkoxy-, acyloxy-, nitro-, cyano-, keto- or halo-groups; a one or more hydroxy-, carboxy-, alkoxy-, carboalkoxy-, acyloxy-, nitro-, cyano-, keto- or halo-groups; a cycloalkyl group having from 3 to 7 carbon atoms; an alkaryl group having from 1 to 20 carbon atoms in the alkyl group and 6 to 14 carbon atoms in the aryl group; an aralkyl group having from 1 to 4 carbon atoms in the alkyl group and 6 to 14 carbon atoms in the aryl group wherein the aryl group is unsubstituted or substituted with one or more alkyl-, hydroxy-, carboxy-, alkoxy-, carboalkoxy-, acyloxy-, amino-, nitro-, cyano-, keto- or halo-groups; phenyl or substituted phenyl;

$R^1$, $R^2$ and $R^3$, which can be the same or different, are independently selected from hydrogen; an alkyl group having from 1 to 24 carbon atoms; hydroxy-; carboxy-; alkoxy-; carboalkoxy-; acyloxy-; amino-; nitro-; cyano-; keto-; or halo-groups; and X, which can be the same or different, is independently selected from fluorine, chlorine, bromine or iodine.

The inventive toners comprise a polymeric binder and a charge-control agent chosen from the salts defined above. The inventive developers comprise carrier particles and the inventive particulate toner defined above.

The salts provide good charge-control in the inventive toners and developers. The salts have decomposition points well above 150° C. and are quickly, efficiently and uniformly dispersed in the inventive toners prepared by melt-blending the salts with appropriate polymeric binders.

DESCRIPTION OF THE PREFERRED EMBODIMENTS

The quaternary phosphonium trihalocuprate salts employed in the toners and developers of the invention are those salts represented by the formula:

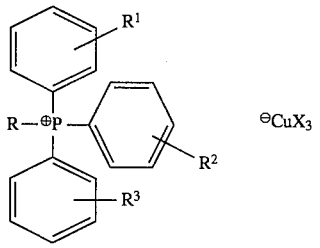

wherein

R is selected from an unsubstituted alkyl group having from 1 to 24 carbon atoms; a substituted alkyl group having from 1 to 24 carbon atoms substituted with one or more hydroxy-, carboxy-, alkoxy-, carboalkoxy-, acyloxy-, nitro-, cyano-, keto- or halo-groups; a cycloalkyl group having from 3 to 7 carbon atoms; an alkaryl group having from 1 to 20 carbon atoms in the alkyl group and 6 to 14 carbon atoms in the aryl group; an aralkyl group having from 1 to 4 carbon atoms in the alkyl group and 6 to 14 carbon atoms in the aryl group wherein the aryl group is unsubstituted or substituted with one or more alkyl-, hydroxy-, carboxy-, alkoxy-, carboalkoxy-, acyloxy-, amino-, nitro-, cyano-, keto- or halo-groups; phenyl or substituted phenyl;

$R^1$, $R^2$ and $R^3$, which can be the same or different, are independently selected from hydrogen; an alkyl group having from 1 to 24 carbon atoms; hydroxy-; carboxy-; alkoxy-; carboalkoxy-; acyloxy-; amino-; nitro-; cyano-; keto; or halo-groups; and X, which can be the same or different, is independently selected from fluorine, chlorine, bromine or iodine.

Illustrative examples of unsubstituted alkyl groups as indicated herein include methyl, ethyl, propyl, isopropyl, butyl, isobutyl, pentyl, hexyl, heptyl, decyl, dodecyl, pentadecyl, octadecyl, docosyl, and the like.

Illustrative examples of substituted alkyl groups as indicated herein include 2-hydroxyethyl, hydroxymethyl, methoxymethyl, cyanomethyl, formylmethyl, acetonyl, chloromethyl, 2-chloroethyl, 4-carboxybutyl, and the like.

Illustrative examples of cycloalkyl groups as indicated herein include cyclobutyl, cyclopentyl, cyclohexyl, and the like.

Illustrative examples of alkaryl groups as indicated herein include 4-methylphenyl, 4-tertbutylphenyl, 6-methyl-2-naphthyl, 2-fluorenyl, and the like.

Illustrative examples of aralkyl groups as indicated herein include benzyl, 2-methylbenzyl, 3-methylbenzyl, 4-methylbenzyl, 4-methoxybenzyl, 4-ethoxybenzyl, 2-hydroxybenzyl, 4-bromobenzyl, 4-chlorobenzyl, 4-fluorobenzyl, 2-nitrobenzyl, 4-nitrobenzyl, 4-cyanobenzyl, 1-naphthylmethyl, and the like.

Specific examples of salts useful in the practice of the present invention include, but are not limited to the following.

Specific Salts benzyltriphenylphosphonium trichlorocuprate
methyl triphenylphosphonium tribromocuprate;
methyl triphenylphosphonium triiodocuprate
methyl triphenylphosphonium trifluorocuprate;
ethyl triphenylphosphonium trichlorocuprate;
ethyl triphenylphosphonium tribromocuprate;
ethyl triphenylphosphonium triiodocuprate;
ethyl triphenylphosphonium trifluorocuprate;
n-propyl triphenylphosphonium tribromocuprate;
n-butyl triphenylphosphonium trichlorocuprate;
n-butyl triphenylphosphonium tribromocuprate;
isobutyl triphenylphosphonium trichlorocuprate;
n-amyl triphenylphosphonium tribromocuprate;
isoamyl triphenylphosphonium tribromocuprate;
isoamyl triphenylphosphonium trifluorocuprate;
n-hexyl triphenylphosphonium trichlorocuprate;
n-heptyl triphenylphosphonium tribromocuprate;
n-octyl triphenylphosphonium tribromocuprate;
n-nonyl triphenylphosphonium trichlorocuprate;
n-decyl triphenylphosphonium tribromocuprate;
n-undecyl triphenylphosphonium tribromocuprate;
n-dodecyl triphenylphosphonium tribromocuprate;
n-tetradecyl triphenylphosphonium tribromocuprate;
n-hexadecyl triphenylphosphonium trichlorocuprate;
2-chloroethyl triphenylphosphonium tribromocuprate;
2-chloroethyl triphenylphosphonium trifluorocuprate;
2-hydroxyethyl triphenylphosphonium tribromocuprate;
3-bromopropyl triphenylphosphonium tribromocuprate;
4-bromobutyl triphenylphosphonium tribromocuprate;
cyclopropylmethyl triphenylphosphonium tribromocuprate;
isopropyl triphenylphosphonium triiodocuprate;
2-butyl triphenylphosphonium tribromocuprate;
cyclopropyl triphenylphosphonium tribromocuprate;
cyclopentyl triphenylphosphonium trichlorocuprate;
cyclohexyl triphenylphosphonium tribromocuprate;
benzyl triphenylphosphonium trichlorocuprate;
benzyl triphenylphosphonium tribromocuprate;
benzyl triphenylphosphonium triiodocuprate;
benzyl triphenylphosphonium trifluorocuprate;

2-methylbenzyl triphenylphosphonium trichlorocuprate;
2-methylbenzyl triphenylphosphonium tribromocuprate;
3-methylbenzyl triphenylphosphonium trichlorocuprate;
4-methylbenzyl triphenylphosphonium trichlorocuprate;
4-methylbenzyl triphenylphosphonium tribromocuprate;
4-methoxybenzyl triphenylphosphonium trichlorocuprate;
4-methoxybenzyl triphenylphosphonium trifluorocuprate;
4-n-butoxybenzyl triphenylphosphonium tribromocuprate;
4-ethoxybenzyl triphenylphosphonium tribromocuprate;
2-hydroxybenzyl triphenylphosphonium tribromocuprate;
4-bromobenzyl triphenylphosphonium tribromocuprate;
4-chlorobenzyl triphenylphosphonium trichlorocuprate;
4-fluorobenzyl triphenylphosphonium trichlorocuprate;
2-nitrobenzyl triphenylphosphonium tribromocuprate;
4-nitrobenzyl triphenylphosphonium tribromocuprate;
4-cyanobenzyl triphenylphosphonium trichlorocuprate;
tetraphenylphosphonium trichlorocuprate;
tetraphenylphosphonium tribromocuprate;
tetraphenylphosphonium triiodocuperate;
2-chlorohexyl triphenylphosphonium trichlorocuprate
methyl bis(4-carbomethoxyphenyl)phenylphosphonium trichlorocuprate;
methyl tris(4-acetoxyphenyl)phosphonium trichlorocuprate;
methyl tritolylphosphonium trichlorocuprate;
methyl tris(4-chlorophenyl)phosphonium trichlorocuprate;
methyl tris(4-carbomethoxyphenyl)phosphonium trichlorocuprate;
methyl 4-acetoxyphenyldiphenylphosphonium trichlorocuprate;
methyl 3,5-bis(4-carbomethoxy)phenyldiphenylphosphonium trichlorocuprate;
4-carboethoxybutyl triphenylphosphonium tribromocuprate;
3-phenylpropyl triphenylphosphonium trichlorocuprate, and
1-naphthylmethyl triphenylphosphonium trichlorocuprate.

The quaternary phosphonium trihalocuprate salts used as charge-control agents in the practice of the present invention can conveniently be prepared from an appropriate phosphonium halide salt and an appropriate copper halide such as cupric fluoride, cupric chloride, cupric bromide or cupric iodide, by reacting the ammonium halide salt with the copper halide in ethanol at a 1:1 mole ratio.

For example, benzyltriphenylphosphonium trichlorocuprate can be prepared by dissolving benzyltriphenylphosphonium chloride in ethanol, adding a solution of an appropriate amount of cupric chloride dihydrate in ethanol, heating the mixture to boiling, filtering the solution while hot and cooling the solution to obtain, as a solid crystalline material, benzyltriphenylphosphonium trichlorocuprate salt.

To be utilized as a charge-control agent in the electrostatographic toners of the invention, the quaternary phosphonium salt is mixed in any convenient manner (preferably by melt-blending) with an appropriate polymeric toner binder material and any other desired addenda, and the mix is then ground to desired size to form a free-flowing powder of toner particles containing the charge agent. Other methods include those well-known in the art such as spray drying, melt dispersion and dispersion polymerization.

Toner particles of the invention have an average diameter between about 0.1 μm and about 100 μ, a value in the range from about 1.0 to about 30 μm being preferable for many currently used machines. However, larger or smaller particles may be needed for particular methods of development or development conditions.

Generally, it has been found desirable to add from about 0.05 to about 6 parts and preferably 0.25 to about 2.0 parts by weight of the aforementioned quaternary Phosphonium trihalocuprate salts per 100 parts by weight of a polymer to obtain the improved toner compositions of the present invention. Of course, it must be recognized that the optimum amount of charge-control agent to be added will depend, in part, on the particular quaternary phosphonium charge-control agents selected and the particular polymer to which it is added. However, the amounts specified hereinabove are typical of the useful range of charge-control agent utilized in conventional dry toner materials.

The polymers useful as toner binders in the practice of the present invention can be used alone or in combination and include those polymers conventionally employed in electrostatic toners. Useful amorphous polymers generally have a glass transition temperature within the range of from 50° to 120° C. Preferably, toner particles prepared from these polymers have relatively high caking temperature, for example, higher than about 60° C., so that the toner powders can be stored for relatively long periods of time at fairly high temperatures without having individual particles agglomerate and clump together. The melting point of useful crystalline polymers preferably is within the range of from about 65° C. to about 200° C. so that the toner particles can readily be fused to a conventional paper receiving sheet to form a permanent image. Especially preferred crystalline polymers are those having a melting point within the range of from about 65° to about 120° C. Of course, where other types of receiving elements are used, for example, metal plates such as certain printing plates, polymers having a melting point or glass transition temperature higher than the values specified above can be used.

Among the various polymers which can be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible crosslinked polymers as described in U.S. Pat. No. Re. 31,072.

Typical useful toner polymers include certain polycarbonates such as those described in U.S. Pat. No. 3,694,359, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkyl acrylate), and poly(alkyl methacrylate) wherein the alkyl moiety can contain from 1 to about 10 carbon atoms. Additionally, other polyesters having the aforementioned physical properties are also useful. Among such other useful polyesters are copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety.

Other useful polymers are various styrene-containing polymers. Such polymers can comprise, a polymerized blend of from about 40 to about 100 percent by weight of styrene, from 0 to about 45 percent by weight of a lower alkyl acrylate or methacrylate having from 1 to 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate (e.g., styrene-butyl acrylate-ethylhexyl acrylate copolymer). Preferred fusible styrene copolymers are those which are covalently crosslinked with a small amount of a divinyl compound such as divinylbenzene. A variety of other useful styrene-containing toner materials are disclosed in U.S. Pat. Nos. 2,917,460; Re. 25,316; 2,788,288; 2,638,416; 2,618,552 and 2,659,670.

Various kinds of well-known addenda (e.g., colorants, release agents, etc.) can also be incorporated into the toners of the invention.

Numerous colorant materials selected from dyestuffs or pigments can be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition.

Included among the vast number of useful colorants are such materials as Hansa Yellow G (C.I. 11680), Nigrosine Spirit soluble (C.I. 50415), Chromogen Black ET00 (C.I. 45170), Solvent Black 3 (C.I. 26150), Fuchsine N (C.I. 42510), C.I. Basic Blue 9 (C.I. 52015). Carbon black also provides a useful colorant. The amount of colorant added may vary over a wide range, for example, from about 1 to about 20 percent of the weight of the polymer. Particularly good results are obtained when the amount is from about 1 to about 10 percent.

To be utilized as toners in the electrostatographic developers of the invention, the toners of this invention can be mixed with a carrier vehicle. The carrier vehicles, which can be used with the present toners to form the new developer compositions, can be selected from a variety of materials. Such materials include carrier core particles and core particles overcoated with a thin layer of a film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the purpose of establishing the correct triboelectric relationship and charge level with the toner employed. Examples of suitable resins are the polymers described in U.S. Pat. Nos. 3,547,822; 3,632,512; 3,795,618; 3,898,170 and Belgian Pat. No. 797,132. Other useful resins are fluorocarbons such as polytetrafluoroethylene, poly(vinylidene fluoride), mixtures of these and copolymers of vinylidene fluoride and tetrafluoroethylene. See, for example, U.S. Pat. Nos. 4,545,060; 4,478,925; 4,076,857; and 3,970,571. Such polymeric fluorocarbon carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition containing the above-described toner and a carrier vehicle generally comprises from about 1 to about 20 percent by weight of particulate toner particles and from about 80 to about 99 percent by weight carrier particles. Usually, the carrier particles are larger than the toner particles. Conventional carrier particles have a particle size on the order of from about 20 to about 1200 micrometers, preferably 30–300 micrometers.

Alternatively, the toners of the present invention can be used in a single component developer, i.e., with no carrier particles.

The charge-control agents of the present invention impart a positive charge to the toner composition. The level of charge on the developer compositions utilizing a charge-control agent of the present invention is preferably in the range of from about 15 to 60 microcoulombs per gram of toner for toner particles having a volume average diameter of from about 7 to 15 micrometers in the developer as determined in accordance with the procedure described below.

The toner and developer compositions of this invention can be used in a variety of ways to develop electrostatic charge patterns or latent images. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following examples are presented to further illustrate the present invention.

EXAMPLE 1

This example describes the preparation of a charge-control agent useful in accordance with the invention which is benzyltriphenylphosphonium trichlorocuprate.

Benzyltriphenylphosphonium trichlorocuprate was prepared by adding a solution of 4.26 g (0.025 mol) cupric chloride.dihydrate in 50 ml ethanol to a 250 ml flask containing a solution of 9.72 g (0.025 mol) of benzyltriphenylphosphonium chloride in 50 ml of ethanol, adding 100 ml of ethanol, heating the mixture to boiling, filtering the mixture while hot through supercel and cooling. The product crystallized as a brown solid which was collected and dried to give 8.25 g (63.06% of theory) of product;

mp=178.5–179.5.

Anal. Calcd. for: $C_{25}H_{22}Cl_3CuP$:C,57.38; H,4.24; Cl,20.32; Cu,12.14; P,5.92; Found: C,57.13; H,4.40; Cl,20.2; Cu,13.0; P,5.67.

Measurement of Salt Decomposition Point

The decomposition point (temperature) of the phosphonium trichlorocuprate salt of Example 1 was measured in air at 10° C./min from 25° to 500° C. in a Perkin-Elmer 7 Series Thermal Analysis System. The decomposition temperature was 214° C. indicating a highly thermally stable material for use in the toner and developer compositions of the present invention.

EXAMPLE 2

Toners and Developers

The salt of Example 1 was employed and evaluated as a charge-control agent in two different concentrations in inventive toners and developers.

Inventive toner samples were formulated by compounding 100 parts of a crosslinked vinyl-addition polymer of styrene, butyl acrylate and divinylbenzene (weight ratio: 77/23/0.4), 6 parts of a carbon black pigment (Black Pearls 430 obtained from Cabot Corporation, Boston, Mass.); and 1 and 2 parts of the charge-control agent of Example 1. The formulations were melt-blended on a two-roll mill at 150° C. on a 4-inch (10.24 cm) roll mill, allowed to cool to room temperature and ground down to form inventive toner particles having an average particle size of approximately 12 micrometers as measured by a Coulter Counter. Inventive developers were prepared by combining 8.0 grams of the toner particles with 92.0 grams of carrier particles comprising strontium ferrite cores which had been coated at 230° C. with 2 pph of polyvinylidene fluoride (Kynar 301F manufactured by Pennwalt Corporation). Toner charges were then measured in microcoulombs per gram of toner (μc/g) in a "MECCA" device according to the following procedure. The developer was vigorously shaken or "exercised" to cause triboelectric charging by placing a 4 gram sample of the developer into a glass vial, capping the vial and shaking the vial on a "wrist-action" shaker operated at about 2 Hertz and an overall amplitude of about 11 cm for 2 minutes. Toner charge level after 2minutes of shaking was measured by placing a 0.1 to 0.2 gram sample of the charged developer in a MECCA apparatus and measuring the charge and mass of transferred toner in the MECCA apparatus. This involved placing the sample of the charged developer in a sample dish situated between electrode plates and subjecting it, simultaneously for 30 seconds, to a 60 Hz magnetic field to cause developer agitation and to an electric field of about 2000 volts/cm between the plates. The toner is released from the carrier and is attracted to and collects on the plate having a polarity opposite to the toner charge. The total toner charge is measured by an electrometer connected to the plate, and that value is divided by the weight of the toner on the plate to yield the charge per mass of toner in microcoulombs per gram (μc/g). The results are shown in Table I, below.

| Charge-Control Agent | Conc. (pph) | MECCA Q/M (μc/g) 2 min. |
|---|---|---|
| Example 1 | 1 | 59.78 |
| | 2 | 56.29 |

The data in Table I show that the charging properties of the inventive toners and developers were good, that a high charge was attained and that the degree of charging can be controlled by varying the amount of salt which is present in the toner composition.

Although the invention has been described in considerable detail with particular reference to certain preferred embodiments thereof, variations and modifications can be effected within the spirit and scope of the invention.

It is claimed that:

1. A dry, particulate electrostatographic toner composition comprising a polymeric binder and a charge-control agent comprising a quaternary phosphonium trihalocuprate salt having the structure:

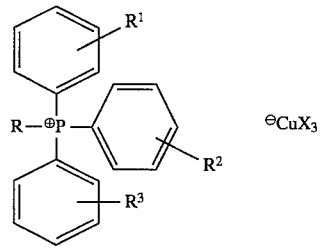

wherein

R represents an unsubstituted alkyl group having from 1 to 24 carbon atoms; a substituted alkyl group having from 1 to 24 carbon atoms substituted with one or more hydroxy-, carboxy-, alkoxy-, carboalkoxy-, acyloxy-, nitro-, cyano-, keto- or halo-groups; a cycloalkyl group having from 3 to 7 carbon atoms; an alkaryl group having from 1 to 20 carbon atoms in the alkyl group and 6 to 14 carbon atoms in the aryl group; an aralkyl group having from 1 to 4 carbon atoms in the alkyl group and 6 to 14 carbon atoms in the aryl group wherein the aryl group is unsubstituted or substituted with one or more alkyl-, hydroxy-, carboxy-, alkoxy-, carboalkoxy-, acyloxy-, amino-, nitro-, cyano-, keto- or halo-groups; phenyl or substituted phenyl;

$R^1$, $R^2$ and $R^3$, which can be the same or different, represents hydrogen; an alkyl group having from 1 to 24 carbon atoms; hydroxy-; carboxy-; alkoxy-; carboalkoxy-; acyloxy-; amino-; nitro-; cyano-; keto-; or halo-groups; and X, which can be the same or different, represents fluorine, chlorine, bromine or iodine.

2. The toner composition of claim 1, wherein the charge-control agent is benzyltriphenylphosponium trichlorocuprate.

3. An electrostatographic developer comprising:

a. a particulate toner composition, comprising a polymeric binder and a charge-control agent comprising a quaternary phosphonium trihalocuprate salt having the structure:

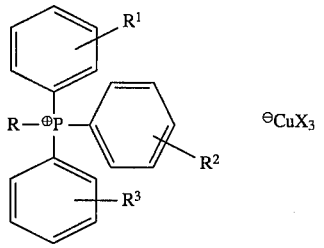

wherein

R represents alkyl group having from 1 to 24 carbon atoms; a substituted alkyl group having from 1 to 24 carbon atoms substituted with one or more hydroxy-, carboxy-, alkoxy-, carboalkoxy-, acyloxy-, nitro-, cyano-, keto- or halo-groups; a cycloalkyl group having from 3 to 7 carbon atoms; an alkaryl group having from 1 to 20 carbon atoms in the alkyl group and 6 to 14 carbon atoms in the aryl group; an aralkyl group having from 1 to 4 carbon atoms in the alkyl group and 6 to 14 carbon atoms in the aryl group wherein the aryl group is unsubstituted or substituted with one or more alkyl-, hydroxy-, carboxy-, alkoxy-, carboalkoxy-, acyloxy-, amino-, nitro-, cyano-, keto- or halo-groups; phenyl or substituted phenyl;

$R^1$, $R^2$ and $R^3$, which can be the same or different, represents hydrogen; an alkyl group having from 1 to 24 carbon atoms; hydroxy-; carboxy-; alkoxy-; carboalkoxy-; acyloxy-; amino-; nitro-; cyano-; keto-; or halo-groups; and X, which can be the same or different, represents fluorine, chlorine, bromine or iodine; and b. carrier particles.

4. The developer of claim 3, wherein the carrier particles comprise core materials coated with a fluorocarbon polymer.

* * * * *